US009875654B2

(12) United States Patent
Aparicio Ojea et al.

(10) Patent No.: US 9,875,654 B2
(45) Date of Patent: Jan. 23, 2018

(54) REAL-TIME MONITORING AND DIAGNOSTIC PROCESSING OF TRAFFIC CONTROL DATA

(71) Applicants: Siemens Aktiengesellschaft, Munich (DE); Siemens Industry, Inc., Alpharetta, GA (US)

(72) Inventors: Juan L. Aparicio Ojea, Doylestown, PA (US); Brian Collum, Austin, TX (US); Andrew Valdez, Austin, TX (US); Bradley Wehrwein, Princeton, NJ (US)

(73) Assignees: Siemens Aktiengesellschaft, Munich (DE); Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 15/007,248

(22) Filed: Jan. 27, 2016

(65) Prior Publication Data

US 2016/0225258 A1 Aug. 4, 2016

Related U.S. Application Data

(60) Provisional application No. 62/109,891, filed on Jan. 30, 2015.

(51) Int. Cl.

| | |
|---|---|
| ***G08G 1/07*** | (2006.01) |
| ***G08G 1/097*** | (2006.01) |
| ***G08G 1/01*** | (2006.01) |

(52) U.S. Cl.

CPC ..... *G08G 1/097* (2013.01); *G08G 1/0116* (2013.01); *G08G 1/0145* (2013.01); *G08G 1/07* (2013.01)

(58) Field of Classification Search

CPC ..... G08G 1/097

USPC ..... 340/907, 911, 912, 915

See application file for complete search history.

(56) References Cited

U.S. PATENT DOCUMENTS 4,383,240 A * 5/1983 Staats, Jr. ..... G08G 1/097 315/132
4,463,339 A * 7/1984 Frick ..... G08G 1/07 340/642
4,814,765 A * 3/1989 DeRoche ..... G08G 1/096 340/911

(Continued)

FOREIGN PATENT DOCUMENTS

WO 20110157745 A1 12/2011

OTHER PUBLICATIONS

Report of Examination dated Jun. 20, 2016; EP Application No. 16153377.3-1803; 7 pages.

*Primary Examiner* — Qutbuddin Ghulamali

(57) ABSTRACT

A traffic control monitoring and abnormality determination system and associated methods are disclosed for receiving and analyzing traffic controller input/output data during a learning phase to determine a model indicative of normal or healthy operation of the traffic controller in regulating traffic flow at an intersection and receiving and evaluating additional traffic controller input/output data against the model during an evaluation phase to determine whether an abnormality exists in operation of the traffic controller. If an abnormality is detected during the evaluation phase, the system may initiate a corrective action to resolve the abnormality such as sending an alarm signal to a traffic controller to cause the traffic controller to alter an operating state to resolve the abnormality.

14 Claims, 7 Drawing Sheets

(56) References Cited

U.S. PATENT DOCUMENTS

2006/0015295 A1* 1/2006 Evans ..... G08G 1/07
702/183

* cited by examiner

REAL-TIME MONITORING AND DIAGNOSTIC PROCESSING OF TRAFFIC CONTROL DATA

CROSS-REFERENCE TO RELATED APPLICATION(S)

This application claims priority to U.S. Provisional Application No. 62/109,891, filed on Jan. 30, 2015, the content of which is incorporated herein in its entirety.

BACKGROUND

Significant cost may be incurred when performing field maintenance on a road traffic controller due to the large number of inputs and outputs received or generated by the road traffic controller and the resultant difficulty in identifying a root cause of abnormal operation of the traffic controller. Existing systems for monitoring operation of a traffic controller and identifying abnormal (and potentially unsafe) operating states rely heavily on manual diagnostics and field maintenance, and thus, suffer from a number of drawbacks. Technical solutions that address at least some of these drawbacks are disclosed herein.

BRIEF DESCRIPTION OF THE DRAWINGS

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. In the drawings, the left-most digit(s) of a reference numeral identifies the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Figure 1A:
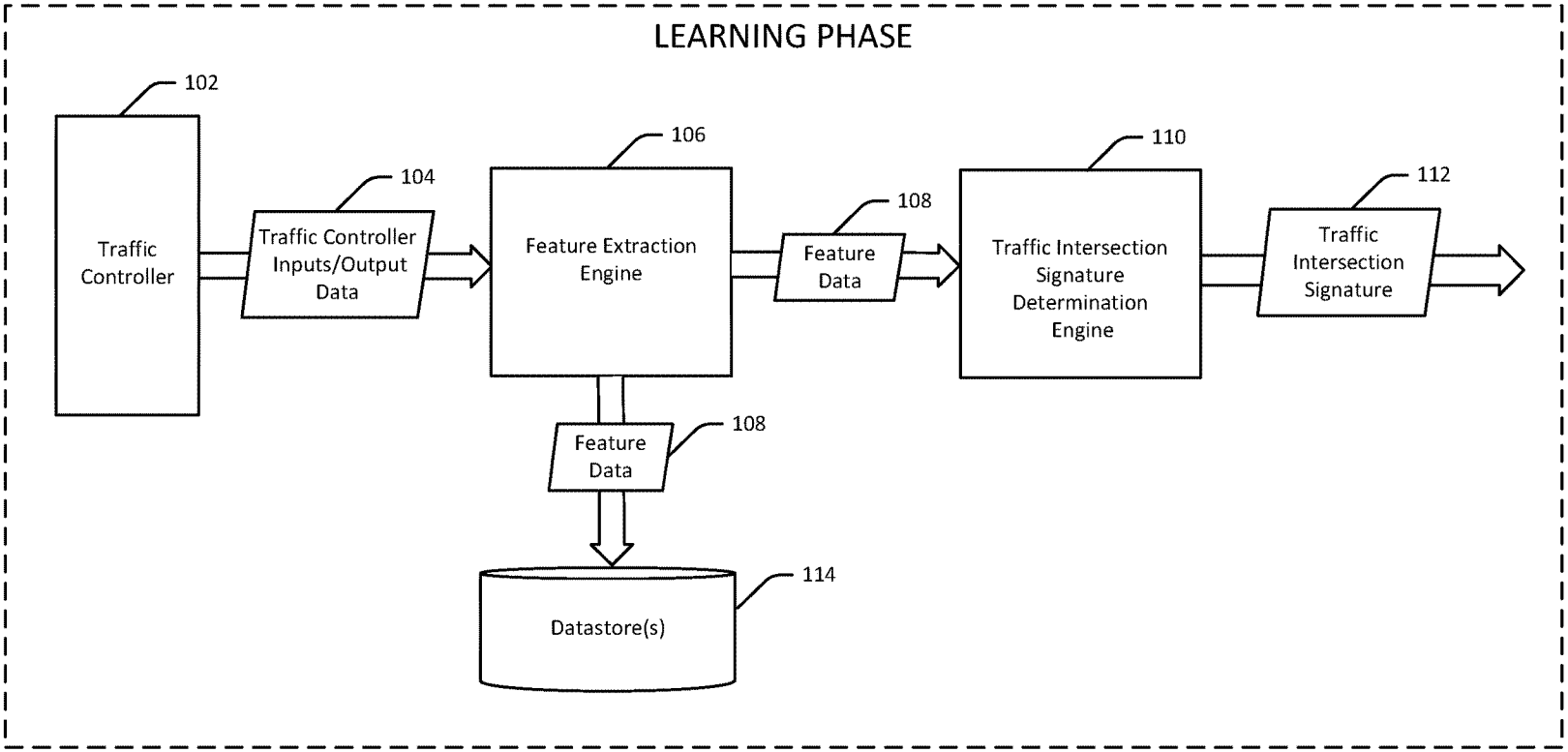
FIG. 1A schematically depicts a learning phase of operation for a traffic control monitoring and abnormality determination system during which a traffic intersection signature is determined in accordance with one or more example embodiments of the disclosure.

This disclosure relates to, among other things, devices, systems, methods, computer-readable media, techniques, and methodologies for receiving and analyzing traffic controller input/output data during a learning phase of operation to determine a model indicative of normal or healthy operation of the traffic controller in regulating traffic flow at an intersection, receiving and evaluating additional traffic controller input/output data against the model during an evaluation phase of operation to determine whether a traffic control abnormality exists, and if an abnormality is present, initiating a corrective action to resolve the abnormality. The learning phase and evaluation phase may be implemented by one or more program modules, engines, or the like executing on one or more servers of a traffic control monitoring and abnormality determination system in accordance with one or more example embodiments of the disclosure (referred to hereinafter as "a traffic control system").

A traffic controller may be or may include an embedded device having hardware, software, and/or firmware configured to regulate the traffic flow of vehicles and/or pedestrians across an intersection. Example embodiments discussed herein are applicable to any type of intersection at which vehicles and/or pedestrians approach one another while travelling in two or more directions. For example, example embodiments discussed herein may be applicable to n-way intersections (where n is an integer value greater than or equal to 2) including, without limitation, the typical 4-way intersection of perpendicular road surfaces, T junctions, Y junctions, diagonal crossings, or the like. Applicable types of intersections may further include, without limitation, traffic circles, roundabouts, box junctions, advanced stop lines, parallel-flow intersections, continuous-flow intersections, hook turns, quadrants, seagull intersections, slip lanes, staggered junctions, superstreets, turnarounds, or the like.

Traffic flow at an intersection may be controlled via any of variety of mechanisms. For example, signage may be used to control an intersection, as is the case with yield-controlled intersections, stop-controlled intersections, or the like. A traffic controller may regulate or control traffic flow at an intersection through the use of traffic signals that may indicate a type of vehicle or a direction of traffic that is permitted to proceed or prohibited from proceeding through the intersection during a particular period of time.

A traffic controller may receive a variety of types of inputs and may generate a variety of types of outputs. Example types of outputs may include, without limitation, green signal time, yellow signal time, red signal time, pedestrian signal time, or the like. Example types of inputs may include, without limitation, various types of calls that may be made such as vehicle calls, pedestrian calls, priority calls (e.g., calls to give priority to emergency vehicles), preemption calls (e.g., calls to give priority to a train at a railroad crossing), or the like. Example traffic controller inputs or outputs may further include traffic control parameters including, without limitation, traffic scheduling using magnetic loops, video detection, or the like.

Due to the large number of inter-correlated traffic controller inputs and outputs, determining the root cause of an abnormality may be a time-intensive task. For example, any number of root causes may cause an abnormality including, without limitation, improper timing configuration of traffic lights, a faulty sensor, a software defect in the traffic controller software, or the like. Determining the root cause of an abnormality may be a vital task as an abnormality may cause non-optimal traffic flow through an intersection, or in worst-case scenarios, dangerous and unsafe traffic flow conditions (e.g., all traffic signals at an intersection being green or red).

Thus, a traffic control abnormality typically must be resolved with high priority due to the potential safety risks it may pose. Conventional practice has been to manually diagnose the root cause of an abnormality. In particular, conventional systems for detecting the presence of an abnormality and determining the root cause of the abnormality are not automated. Further, such conventional systems lack the capability to detect an imminent abnormality and alert a traffic controller to take action to mitigate the likelihood of the abnormality occurring.

For instance, in conventional practice, when a traffic control problem occurs, a municipality or state transportation department typically deploys a technician to the field to investigate the problem. Most transportation departments have guidelines for traffic maintenance. The maintenance and traffic control investigation performed by a technician is typically strenuous work, involving the technician going from one intersection to another and observing traffic patterns and conditions until the abnormality reoccurs.

If the root cause of the abnormality is determined to relate to the traffic controller software, the controller is typically returned to the vendor for debugging. Because traffic controller software is typically customized for the client and the particular intersection at which it will be regulating traffic flow, the debugging process can be complicated and time-consuming. The debugging process typically involves manual review of the traffic controller logs in an attempt to manually reproduce the abnormality.

A traffic control system in accordance with example embodiments of the disclosure addresses some if not all of the above-mentioned drawbacks associated with conventional systems. The traffic control system may be configured to implement two phases of operation: a learning phase and an evaluation/correction phase. During the learning phase, traffic controller input/output data may be received by a feature extraction engine of the traffic control system. The traffic controller input/output data may include data indicative of inputs received by the traffic controller and/or outputs generated by the traffic controller over some period of time. The inputs and outputs may include any of those previously described.

The feature extraction engine may be configured to generate feature data based on the traffic controller input/output data. More specifically, the feature extraction engine may be configured to determine, from the traffic controller input/output data, the values for one or more features. The features may be, for example, time-based and/or frequency-based statistical measures deemed relevant for determining a model of traffic flow at the intersection controlled by the traffic controller. The traffic controller input/output data used to determine the features may be ground-truth data assumed to be reflective of the expected operation of the traffic controller (e.g., normal or healthy operation of the traffic controller). It should be appreciated that normal or healthy operation of the traffic controller may not correspond to desirable traffic conditions. That is, the expected behavior of a traffic controller does not necessarily depend on traffic flow through an intersection (e.g., the number of vehicles crossing the intersection). For example, in some situations, a healthy traffic controller operating state may result in undesirable traffic conditions (e.g., an abnormally long traffic jam).

The traffic control system may further include a traffic intersection signature determination engine. The traffic intersection signature determination engine may be configured to generate an intersection signature for the intersection, which may be a model of expected (e.g., normal or healthy) traffic flow at the intersection based on the feature data. The terms intersection signature, model, and intersection model may be used interchangeably throughout this disclosure. The traffic intersection signature determination engine may be configured to utilize signal processing and machine learning techniques based, for example, on neural networks or the like. For example, the traffic intersection signature determination engine may be configured to utilize a self-organizing feature map, which is a type of artificial neural network that is trained using unsupervised learning to produce a low-dimensional (typically two-dimensional) discretized representation of the input space of training samples. The intersection signature may provide a two-dimensional view of expected traffic flow over time.

In certain example embodiments, different intersection signatures may be determined for different operating conditions. An operating condition of an intersection may be determined from sensor data received from one or more traffic sensors. An operating condition may represent a traffic flow state (e.g., a number of vehicles crossing an intersection over a given period of time, an average length of traffic jams, etc.); a time of day (e.g., rush hour time period); and so forth. Accordingly, the same operating condition may reoccur at various times during a day or on different days.

In order example embodiments, an intersection signature may be dynamically adjusted based on changes in operating conditions. More specifically, weights applied to different model features (e.g., coefficients by which different time-based or frequency-based statistical values are multiplied) in generating the intersection signature may be dynamically adjusted based on a change in an operating condition of the intersection. For example, for operating conditions associated with high traffic congestion, features indicative of peak values (e.g., maximum duration of wait time at a traffic light) may be weighted lower.

The evaluation phase may follow the learning phase. In the evaluation phase, a traffic abnormality evaluation engine of the traffic control system may evaluate traffic controller input/output data against the intersection signature to determine whether an abnormality is present. The traffic abnormality evaluation engine may be configured to receive the intersection signature and real-time, monitored traffic controller input/output data as inputs and compare the traffic controller input/output data to the intersection signature to determine whether an abnormality in traffic controller operation (or an abnormality in traffic flow/behavior indicative of a traffic controller operation problem) exists. More specifically, the traffic abnormality evaluation engine may generate a metric indicative of an extent of deviation between the received traffic controller input/output data and the intersection signature. Such a metric may be referred to herein as an intersection health indicator. The traffic abnormality evaluation engine may be configured to perform the above-described evaluation for each specified unit of time (e.g., from 100 ms to several seconds).

The intersection health indicator may be a value within any suitable range such as, for example, a value between 0 and some value n>0 . A threshold value t may be selected such that intersection health indicator values that are less than t indicate normal expected traffic behavior at the intersection, while intersection health indicator values greater than t indicate an abnormality in the traffic flow/behavior at the intersection. In other example embodiments, an intersection health indicator value greater than t may indicate expected traffic behavior at the intersection, while an intersection health indicator value less than t may indicate an abnormality. Depending on the implementation, an intersection health indicator value that equals the threshold value may indicate normal traffic behavior or an abnormality. Intersection health indicator values may be described herein as satisfying or failing to satisfy a threshold value. Depending on the implementation, a first value may satisfy a second value if the first value meets or exceeds the second value or if the first value meets or falls below the second value. Intersection health indicator values that are close to the threshold value t but still less than t may indicate a deviation from the intersection signature that is more significant than smaller intersection health indicator values, but not a significant enough deviation to be judged an abnormality.

Upon determining that an intersection health indicator value fails to satisfy the threshold value t, a traffic control engine of the traffic control system may transmit an alarm signal to the traffic controller to cause the traffic controller to modify an internal operating state to eliminate or mitigate the abnormality. The alarm signal may include an indication of the nature of the abnormality such as, for example, the feature values whose deviation from the intersection signature is causing the abnormality and/or the particular inputs or outputs impacting the feature values. For example, the traffic controller may adjust one or more inputs and/or adjust one or more outputs to modify its internal operating state to address the abnormality. In this manner, manual maintenance and investigation of traffic controller operational problems may be avoided.

In certain example embodiments, intersection signatures relating to different intersections may be compared to detect abnormalities relating to traffic behavior across multiple intersections, determine whether different detected abnormalities are linked, determine whether an abnormality detected at a particular intersection is likely to occur at or impact other intersections, or the like. For example, intersection signatures corresponding to multiple intersections may be aggregated to obtain a composite intersection signature associated with a larger travel area containing multiple intersections (a vehicle corridor, a part of town, a city, etc.). Real-time traffic controller input/output data may be received and compared to the composite intersection signature to determine whether abnormalities are present, and if so, where they are located (e.g., which intersections they are associated with).

If multiple abnormalities are detected, the composite intersection signature may be used to determine whether the abnormalities are linked. For example, the intersection behavior that is causing a first abnormality to occur at a first intersection may result in traffic conditions that lead to a second abnormality to occur at a second intersection. This link between the first abnormality and the second abnormality may be determined, for example, by determining the relative locations of the first and second intersections and the timing between receipt of anomalous traffic controller input/output data for the first intersection and anomalous traffic controller input/output data for the second intersection. Multiple abnormalities that are linked to one another may represent, for example, an anomalous traffic situation that extends across multiple intersections (e.g., an overturned bus that is blocking several lanes of a busy road).

In certain example embodiments, intersection signatures corresponding to different intersections may be compared to predict the likelihood that an abnormality detected at a first intersection will occur at a second intersection. For example, the second intersection may be predicted to experience the same or a similar abnormality as the first intersection if the intersection signatures for the two intersections are similar. As another example, based on the relative locations of the first and second intersections and expected traffic conditions/patterns, a determination may be made as to the likelihood that the first abnormality detected at the first intersection will result in traffic conditions that cause a second different abnormality to occur at the second intersection.

While example embodiments of the disclosure may be described herein in connection with the detection of an existing abnormality, it should be appreciated that the traffic abnormality evaluation engine may also be configured to identify potential abnormalities before they occur, and the traffic control engine may be configured to transmit an alert to the traffic controller of such imminent abnormalities, thereby allow the traffic controller to modify its internal operating state in anticipation of an abnormality occurring so as to avoid occurrence of the abnormality. For example, the traffic abnormality evaluation engine may be configured to determine that traffic controller input/output data received from the traffic controller is progressively deviating more and more from the intersection signature, and thus, trending towards the occurrence of an abnormality.

Example embodiments of the disclosure include or yield various technical features, technical effects, and/or improvements to technology. Example embodiments of the disclosure provide a traffic control system that utilizes machine learning techniques to determine an intersection signature for an intersection based on feature data determined from traffic controller input/output data. The intersection signature provides a model of expected behavior of traffic flow at the intersection under normal conditions. Subsequent traffic controller input/output data can then be evaluated against the intersection signature to determine whether an abnormality is occurring or is expected to occur in the operation of the traffic controller. If an abnormality is detected or the traffic controller input/output data is trending towards an abnormality, the traffic control system is configured to send an alarm signal to the traffic controller. The alarm signal may include an indication of the nature of abnormality such as, for example, the feature values whose deviation from the intersection signature is causing the abnormality or causing the trend towards the abnormality and/or the particular inputs or outputs impacting the feature values. Based on receipt of the alarm signal, a traffic controller may adjust its internal state by, for example, adjusting one or more inputs or outputs.

The determination and use of an intersection signature in accordance with example embodiments of the disclosure constitutes a technical feature that yields the technical effect of automated traffic controller abnormality detection and resolution. As a result of these technical features and technical effects, a traffic control system in accordance with example embodiments of the disclosure represents an improvement to traffic control technology over existing traffic control systems. It should be appreciated that the above examples of technical features, technical effects, and improvements to technology of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of embodiments disclosed herein are also within the scope of this disclosure. The above-described embodiments and additional and/or alternative embodiments of the disclosure will be described in detail hereinafter through reference to the accompanying drawings.

Illustrative Traffic Control System and Processes

Figure 4:
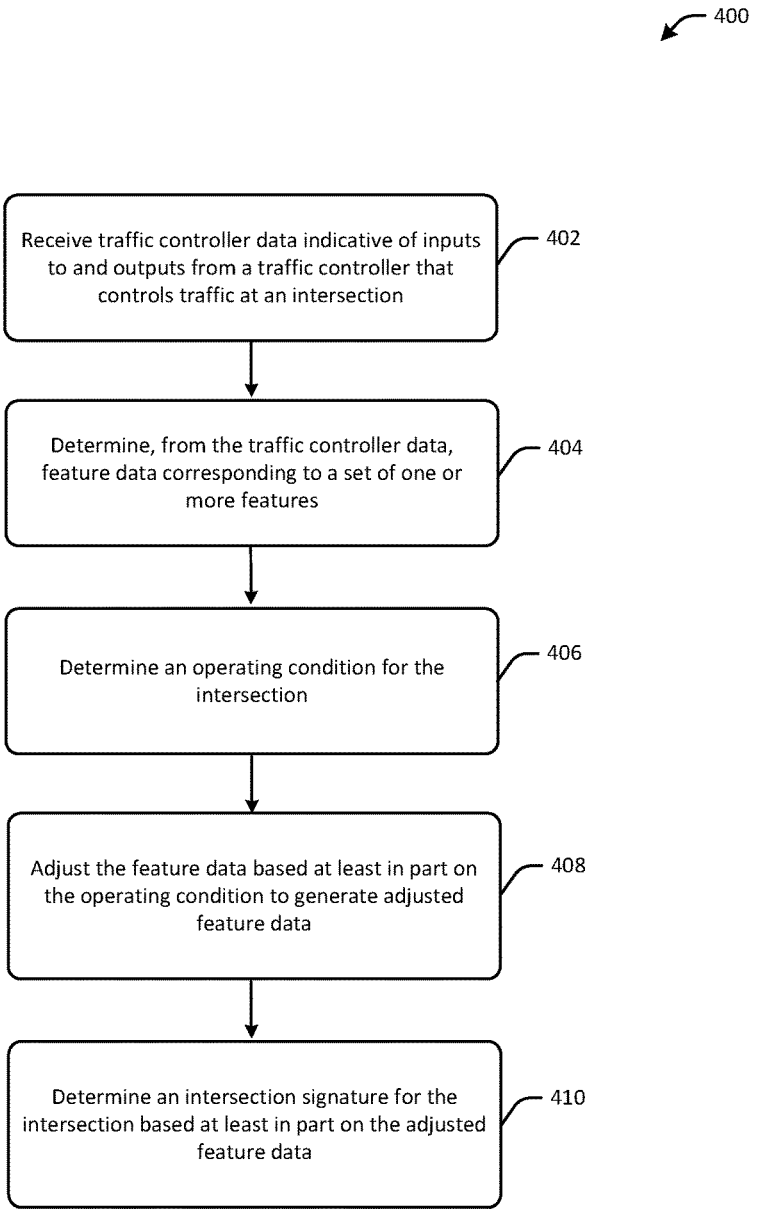
FIG. 4 is a process flow diagram of an illustrative method for determining an intersection signature in accordance with one or more example embodiments of the disclosure.

FIG. 1A schematically depicts a learning phase of operation for a traffic control system during which a traffic intersection signature is determined in accordance with one or more example embodiments of the disclosure. FIG. 4 is a process flow diagram of an illustrative method 400 for determining an intersection signature in accordance with one or more example embodiments of the disclosure. One or more operations of the method 400 may be performed responsive to execution of computer-executable instructions, code, or the like of one or more engines or program modules of the traffic control system. FIG. 1A will be described in conjunction with FIG. 4 hereinafter.

A traffic controller 102 is depicted in FIG. 1A. The traffic controller 102 may receive a variety of types of inputs and may generate a variety of types of outputs. Example types of inputs and outputs may include, without limitation, any of those previously described. During the learning phase, the traffic controller 102 may transmit (via a push or pull mechanism) traffic controller input/output data 104 to a feature extraction engine 106 of the traffic control system, which may be received at block 402 of method 400. The traffic controller input/output data 104 may include data indicative of inputs received by the traffic controller and/or outputs generated by the traffic controller over some period of time.

Figure 2:
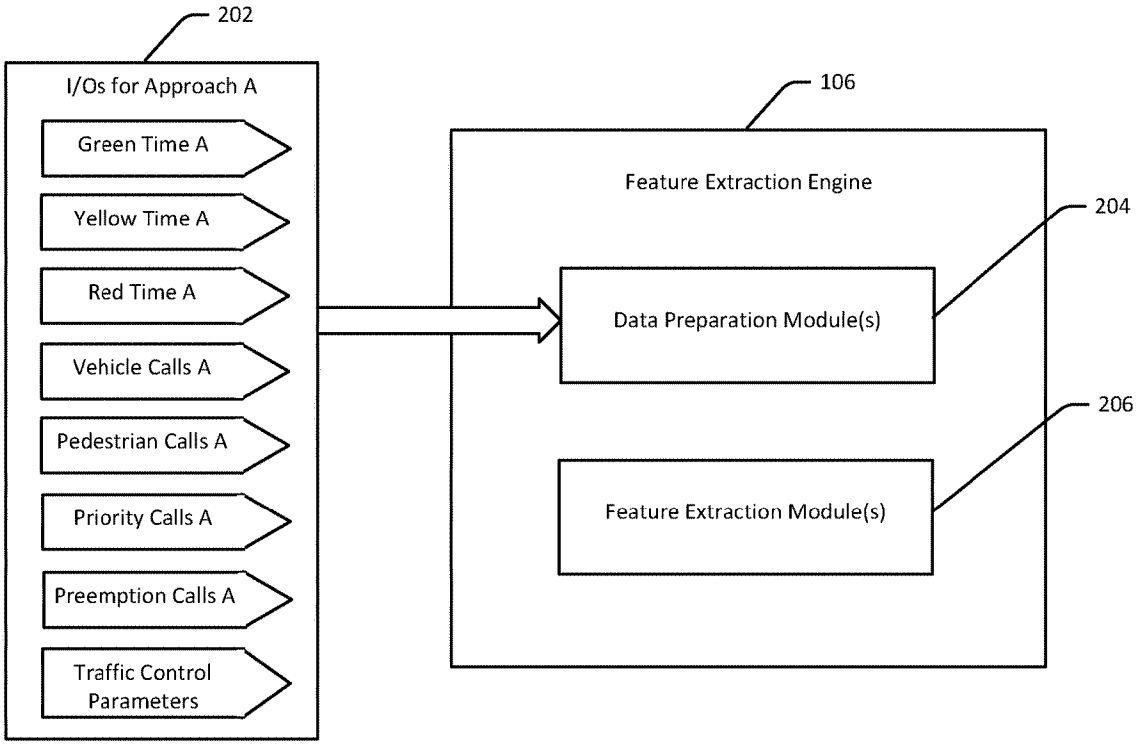
FIG. 2 is a schematic diagram depicting generation of feature data based on traffic controller input/output data in accordance with one or more example embodiments of the disclosure.

At block 404, the feature extraction engine 106 may be configured to determine feature data 108 based on the traffic controller input/output data 104. FIG. 2 is a schematic diagram depicting generation of the feature data 108 based on the traffic controller input/output data 104 in accordance with one or more example embodiments of the disclosure. As shown in FIG. 2, the feature extraction engine 106 may include, without limitation, one or more data preparation modules 204 and one or more feature extraction modules 206. The data preparation module(s) 204 may receive the traffic controller input/output data 104 as input. As previously described, the traffic controller input/output data 104 may include data relating to various inputs and outputs 202 corresponding to the traffic controller 102 such as any of the example types of inputs and outputs 202 depicted in FIG. 2. The traffic controller input/output data 104 may be ground-truth data assumed to be reflective of the expected operation of the traffic controller 102 (e.g., normal or healthy operation of the traffic controller 102.

The data preparation module(s) 204 may include computer-executable instructions, code, or the like, that when executed by one or more processing units of the traffic control system, may cause operations to be performed to execute various statistical or mathematical functions including, without limitation, mean subtraction, framing, windowing (e.g., determining a Hamming window, zero padding, etc.), or the like. Execution of the data preparation module(s) 204 on the traffic controller input/output data 104 may result in the generated of prepared data.

The feature extraction module(s) 206 may include computer-executable instructions, code, or the like, that responsive to execution by one or more processing units of the traffic control system, may cause operations to be performed for receiving the prepared data as input from the data preparation module(s) 204 and determining the values for one or more features. The features may be, for example, time-based and/or frequency-based statistical measures deemed relevant for determining a model of traffic flow at the intersection controlled by the traffic controller 102.

Referring again to FIG. 1A, the feature data 108 may be stored in one or more datastores 114 as well as provided as input to a traffic intersection signature determination engine 110. The traffic intersection signature determination engine 110 may form part of the traffic control system and may be configured to generate an intersection signature 112 for the intersection, which may be a model of expected (e.g., normal or healthy) traffic flow at the intersection based on the feature data 108. The traffic intersection signature determination engine 110 may be configured to utilize signal processing and machine learning techniques based, for example, on neural networks or the like. For example, the traffic intersection signature determination engine 110 may be configured to utilize a self-organizing feature map to produce a low-dimensional (typically two-dimensional) discretized representation of the input space of training samples. The intersection signature 112 may provide a two-dimensional view of expected traffic flow over time.

Figure 3:
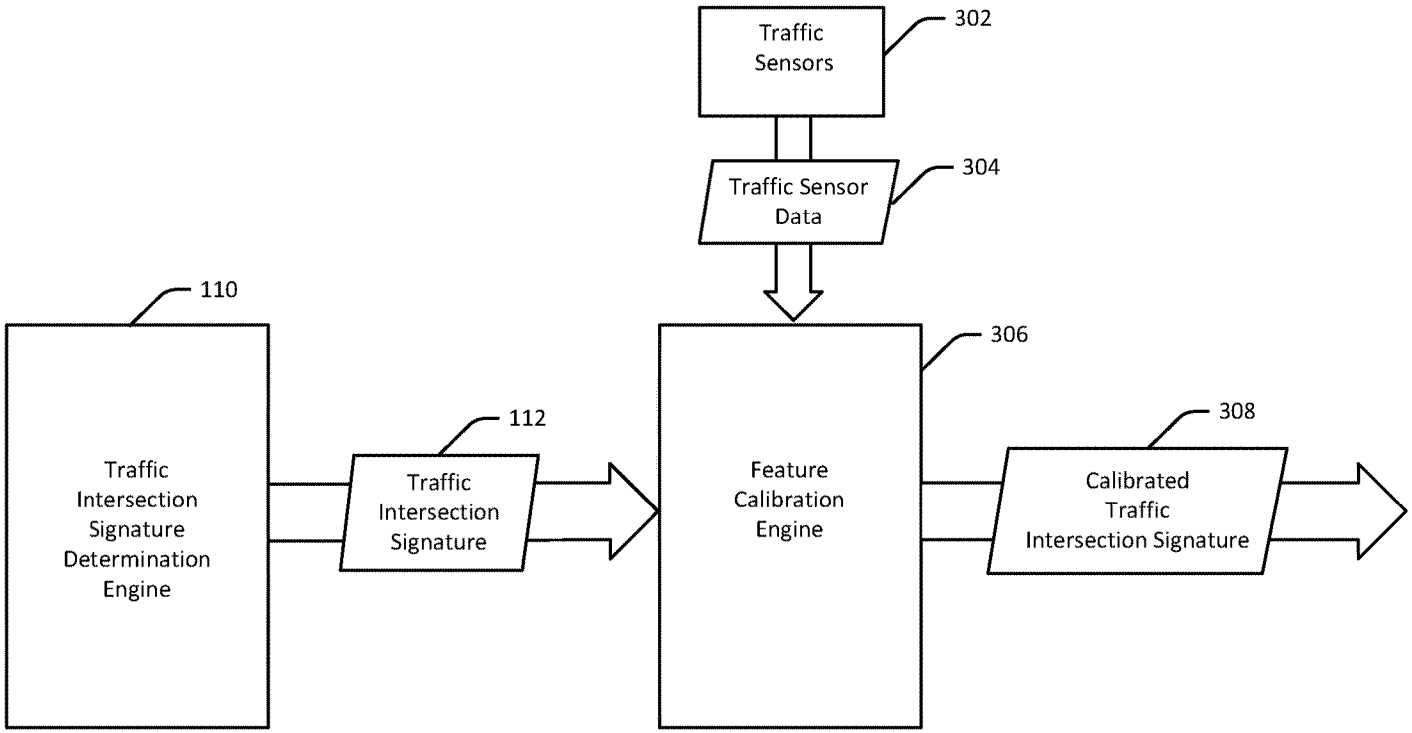
FIG. 3 schematically depicts calibration of a traffic intersection signature by a feature calibration engine in accordance with one or more example embodiments of the disclosure.

In certain example embodiments, the intersection signature 112 may be calibrated to a particular operating condition. FIG. 3 schematically depicts calibration of a traffic intersection signature by a feature calibration engine in accordance with one or more example embodiments of the disclosure. Now referring to FIGS. 1A, 3, and 4 in conjunction with one another, an operating condition of an intersection controlled by the traffic controller 102 may be determined at block 406 from traffic sensor data 304 received from one or more traffic sensors 302. An operating condition may represent a traffic flow state, a time of day, and so forth. Accordingly, the same operating condition may reoccur at various times during a day or on different days.

The feature calibration engine 306 may receive the traffic sensor data 304 as input and determine the operating condition based on the traffic sensor data 304. The feature calibration engine 306 may further receive the intersection signature 112 determined by the traffic intersection signature determination engine 110 as input. The feature calibration engine 306 may include computer-executable instructions, code, or the like, that responsive to execution by one or more processing units of the traffic control system, may cause operations to be performed at block 408 to adjust the feature data 108 to generate adjusted feature data. More specifically, the feature calibration engine 306 may adjust the weights applied to different model features (e.g., the coefficients by which different time-based or frequency-based statistical values are multiplied) to generated the adjusted feature data. Then, at block 410, the intersection signature 112 may be calibrated based on the adjusted feature data to determine a calibrated intersection signature 308. The calibrated intersection signature 308 may be tailored to the operating condition indicated by the traffic sensor data 304. For example, if the operating condition is associated with high traffic congestion, features indicative of peak values (e.g., maximum duration of wait time at a traffic light) may be weighted lower in the calibrated intersection signature 308.

It should be appreciated that, in certain example embodiments, the feature calibration engine 306 may be a sub-engine of the traffic intersection signature determination engine 110. For example, the adjusted feature data may be generated as part of the operations executed by the traffic intersection signature determination engine 110 to determine the intersection signature 112. That is, the intersection signature 112 may be determined based on adjusted feature data, and thus, the output of the traffic intersection signature determination engine 110 may be the calibrated intersection signature 308. Further, in certain example embodiments, different intersection signatures may be determined for different operating conditions. For example, a first intersection signature may be determined that is calibrated for a first operating condition and a second different intersection signature may be determined that is calibrated for a second different operating condition.

Figure 1B:
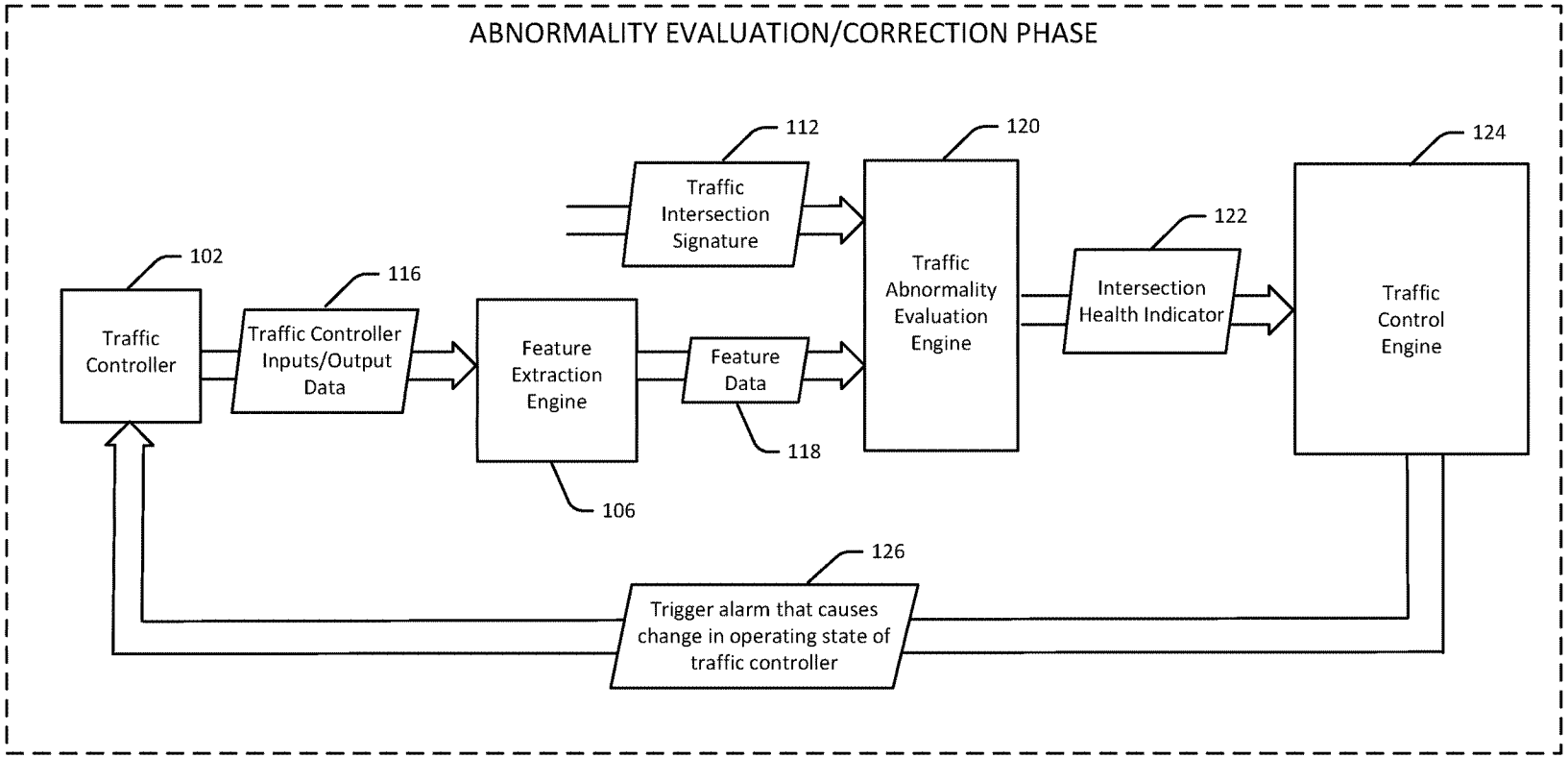
FIG. 1B schematically depicts an abnormality evaluation/correction phase of operation for a traffic control monitoring and abnormality determination system during which traffic controller input/output data is evaluated against a traffic intersection signature to determine whether a traffic control abnormality exists in accordance with one or more example embodiments of the disclosure.
Figure 5:
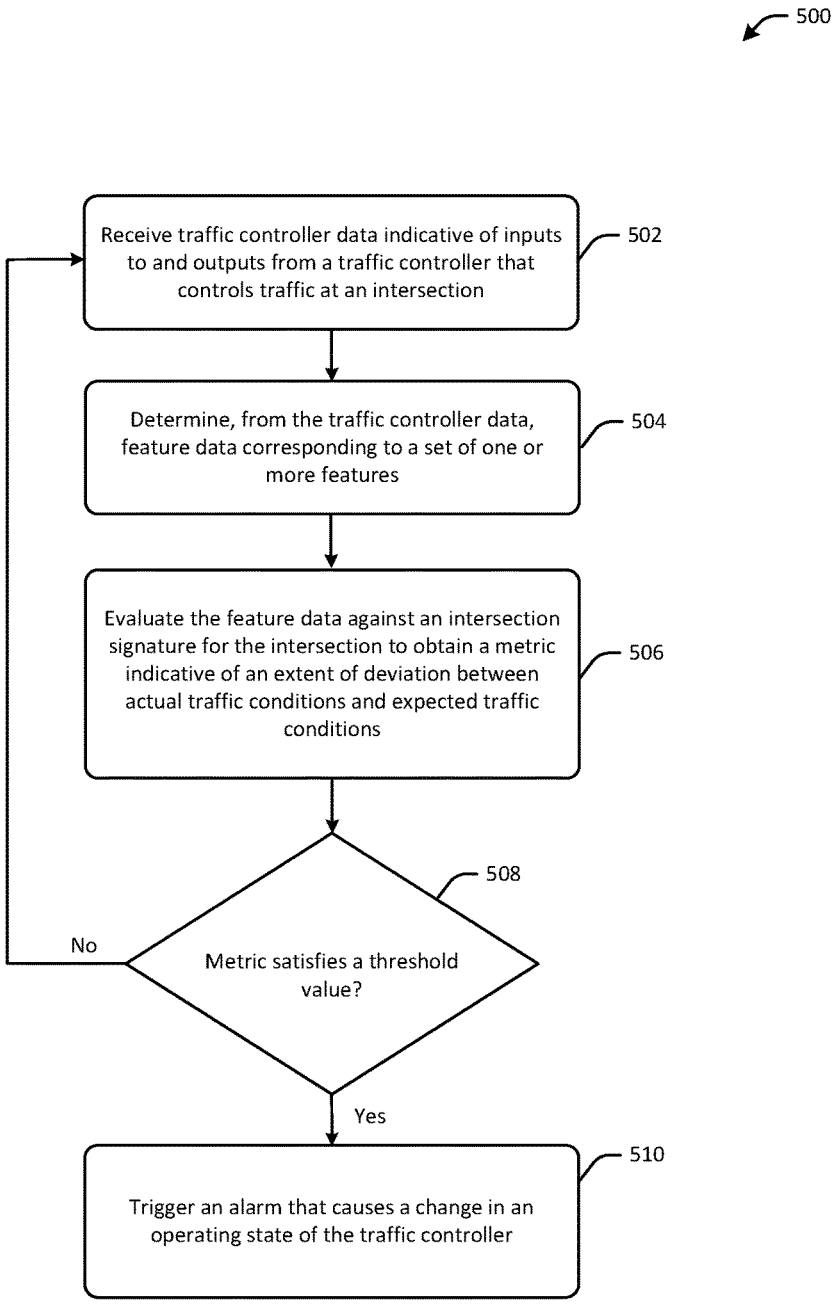
FIG. 5 is a process flow diagram of an illustrative method for evaluating traffic controller input/output data against a traffic intersection signature to determine that a traffic control abnormality exists and initiating an action to resolve the abnormality in accordance with one or more example embodiments of the disclosure.

FIG. 1B schematically depicts an abnormality evaluation/correction phase of operation for the traffic control system during which traffic controller input/output data is evaluated against s traffic intersection signature to determine whether a traffic control abnormality exists in accordance with one or more example embodiments of the disclosure. FIG. 5 is a process flow diagram of an illustrative method 500 for evaluating traffic controller input/output data against a traffic intersection signature to determine that a traffic control abnormality exists and initiating an action to resolve the abnormality in accordance with one or more example embodiments of the disclosure. One or more operations of the method 500 may be performed responsive to execution of computer-executable instructions, code, or the like of one or more engines or program modules of the traffic control system. FIG. 1B will be described in conjunction with FIG. 5 hereinafter.

The evaluation phase may follow the learning phase. In the evaluation phase, a traffic abnormality evaluation engine 120 of the traffic control system may evaluate traffic controller input/output data 116 against the intersection signature 112 to determine whether an abnormality is present. The traffic controller input/output data 116 may include real-time, monitored traffic controller data and may be received by the feature extraction engine 106 at block 502. At block 504, the feature extraction engine 106 may be executed to generate feature data 118 from the traffic controller input/output data 116. The traffic abnormality evaluation engine 120 may include computer-executable instructions, code, or the like, that responsive to execution by one or more processing units of the traffic control system, may cause operations to be performed to receive the intersection signature 112 and the feature data 118 as inputs and compare the feature data 118 to the intersection signature 112 to determine whether an abnormality in operation of the traffic controller 102 (or an abnormality in traffic flow/behavior indicative of a traffic controller operation problem) exists. More specifically, at block 506, the traffic abnormality evaluation engine 120 may compare the feature data 118 to the intersection signature 112 and generate a metric 122 indicative of an extent of deviation between the received traffic controller input/output data 116 and the intersection signature 112 (e.g., an extent of deviation between actual traffic conditions and expected traffic conditions). The metric 122 may be an intersection health indicator. The traffic abnormality evaluation engine 120 may be configured to perform the above-described evaluation for each specified unit of time (e.g., from 100 ms to several seconds).

The intersection health indicator 122 may be a value within any suitable range such as, for example, a value between 0 and some value n>0 . A threshold value t may be selected against which the intersection health indicator 122 may be compared to determine whether an abnormality exists. A traffic control engine 124 may form part of the traffic control system. The traffic control engine 124 may include computer-executable instructions, code, or the like, that responsive to execution by one or more processing units of the traffic control system, may cause operations to be performed at block 508 to compare the intersection health indicator 122 to the threshold value t. In response to negative determination at block 508, the method 500 may return to block 502 and may be performed iteratively as new traffic controller input/output data is received.

On the other hand, in response to a positive determination at block 508 (e.g., if the traffic control engine 124 determines that the intersection health indicator value fails to satisfy the threshold value t), the traffic control engine 124 may transmit or otherwise trigger transmission of an alarm signal 126 to the traffic controller 102 to cause the traffic controller 102 to modify an internal operating state to eliminate or mitigate the abnormality. The alarm signal 126 may include an indication of the nature of the abnormality such as, for example, the feature values whose deviation from the intersection signature 112 is causing the abnormality and/or the particular inputs or outputs impacting the feature values. For example, the traffic controller 102 may adjust one or more inputs and/or adjust one or more outputs to modify its internal operating state to address the abnormality. In this manner, manual maintenance and investigation of traffic controller operational problems may be avoided.

Illustrative Networked Architecture

Figure 6:
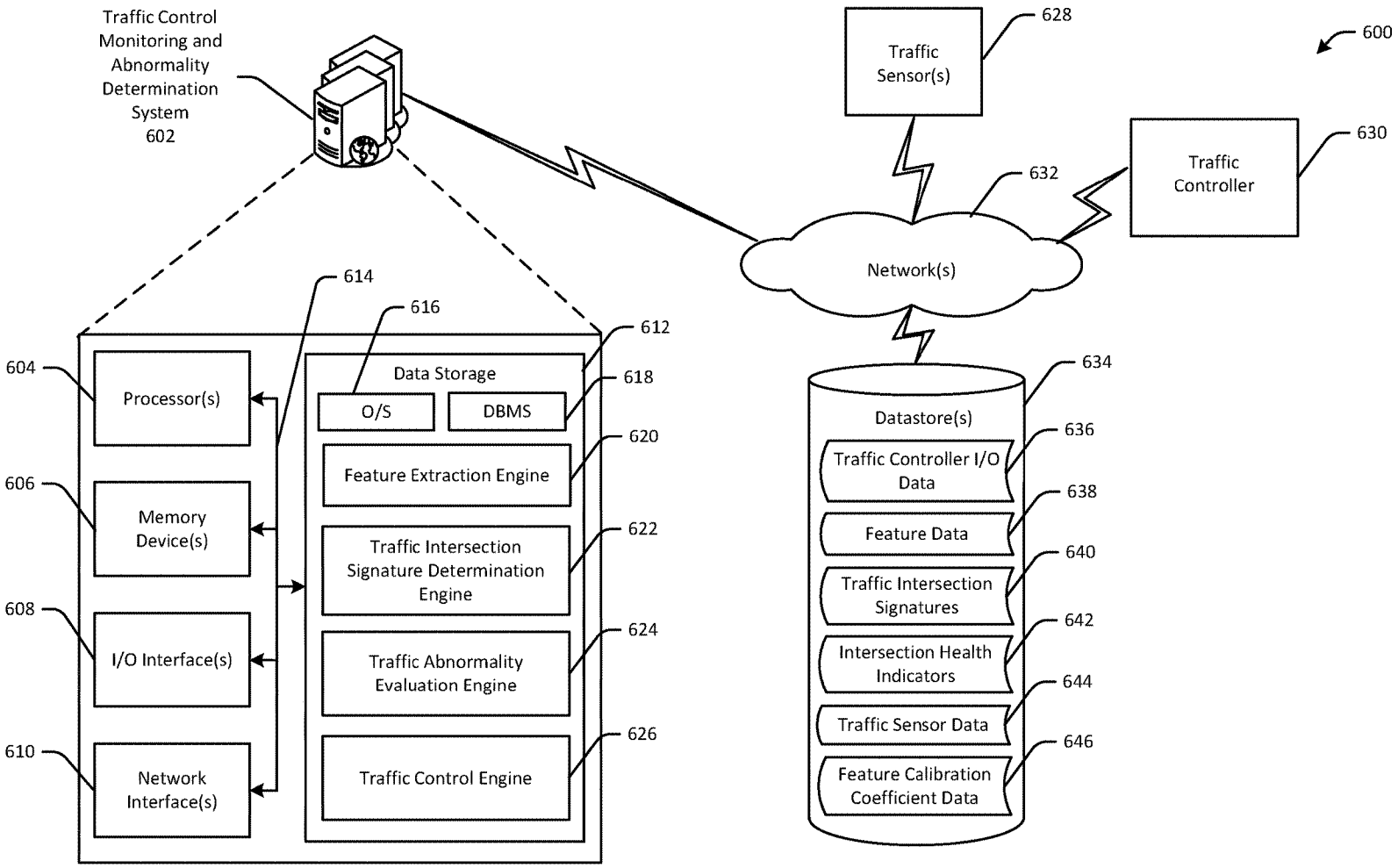
FIG. 6 is a schematic diagram of an illustrative networked architecture in accordance with one or more example embodiments of the disclosure.

FIG. 6 is a schematic diagram of an illustrative networked architecture in accordance with one or more example embodiments of the disclosure. The networked architecture 600 may include a traffic controller 630 (which may correspond to the traffic controller 102), one or more traffic sensors 628 (which may correspond to the traffic sensor(s) 302), and a traffic control system 602. These components of the architecture 600 may be configured to communicate via one or more networks 632.

The network(s) 632 may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, the network(s) 632 may have any suitable communication range associated therewith and may include, for example, global networks (e.g., the Internet), metropolitan area networks (MANs), wide area networks (WANs), local area networks (LANs), or personal area networks (PANs). In addition, the network(s) 632 may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the traffic control system 602 may one or more servers that may include one or more processors (processor(s)) 604, one or more memory devices 606 (generically referred to herein as memory 606), one or more input/output ("I/O") interface(s) 608, one or more network interfaces 610, and data storage 612. The traffic control system 602 may further include one or more buses 614 that functionally couple various components of the traffic control system 602.

The bus(es) 614 may include at least one of a system bus, a memory bus, an address bus, or a message bus, and may permit exchange of information (e.g., data (including computer-executable code), signaling, etc.) between various components of the traffic control system 602. The bus(es) 614 may include, without limitation, a memory bus or a memory controller, a peripheral bus, an accelerated graphics port, and so forth. The bus(es) 614 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnects (PCI) architecture, a PCI-Express architecture, a Personal Computer Memory Card International Association (PCMCIA) architecture, a Universal Serial Bus (USB) architecture, and so forth.

The memory 606 of the traffic control system 602 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 606 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 606 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 612 may include removable storage and/or non-removable storage including, but not limited to, magnetic storage, optical disk storage, and/or tape storage. The data storage 612 may provide non-volatile storage of computer-executable instructions and other data. The memory 606 and the data storage 612, removable and/or non-removable, are examples of computer-readable storage media (CRSM) as that term is used herein.

The data storage 612 may store computer-executable code, instructions, or the like that may be loadable into the memory 606 and executable by the processor(s) 604 to cause the processor(s) 604 to perform or initiate various operations. The data storage 612 may additionally store data that may be copied to memory 606 for use by the processor(s) 604 during the execution of the computer-executable instructions. Moreover, output data generated as a result of execution of the computer-executable instructions by the processor(s) 604 may be stored initially in memory 606, and may ultimately be copied to data storage 612 for non-volatile storage.

More specifically, the data storage 612 may store one or more operating systems (0/S) 616; one or more database management systems (DBMS) 618; and one or more program modules, applications, engines, computer-executable code, scripts, or the like such as, for example, a feature extraction engine 620, a traffic intersection signature determination engine 622, a traffic abnormality evaluation engine 624, and a traffic control engine 626. Any of the components depicted as being stored in data storage 612 may include any combination of software, firmware, and/or hardware. The software and/or firmware may include computer-executable code, instructions, or the like that may be loaded into the memory 606 for execution by one or more of the processor(s) 604 to perform any of the operations described earlier in connection with correspondingly named engines.

The data storage 612 may further store various types of data utilized by components of the traffic control system 602. Any data stored in the data storage 612 may be loaded into the memory 606 for use by the processor(s) 604 in executing computer-executable code. In addition, any data depicted as being stored in the data storage 612 may potentially be stored in one or more of the datastores 634 and may be accessed via the DBMS 618 and loaded in the memory 606 for use by the processor(s) 604 in executing computer-executable code.

The processor(s) 604 may be configured to access the memory 606 and execute computer-executable instructions loaded therein. For example, the processor(s) 604 may be configured to execute computer-executable instructions of the various program modules, applications, engines, or the like of the traffic control system 602 to cause or facilitate various operations to be performed in accordance with one or more embodiments of the disclosure. The processor(s) 604 may include any suitable processing unit capable of accepting data as input, processing the input data in accordance with stored computer-executable instructions, and generating output data. The processor(s) 604 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 604 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 604 may be capable of supporting any of a variety of instruction sets.

Referring now to other illustrative components depicted as being stored in the data storage 612, the O/S 616 may be loaded from the data storage 612 into the memory 606 and may provide an interface between other application software executing on the traffic control system 602 and hardware resources of the traffic control system 602. More specifically, the O/S 616 may include a set of computer-executable instructions for managing hardware resources of the traffic control system 602 and for providing common services to other application programs (e.g., managing memory allocation among various application programs). In certain example embodiments, the O/S 616 may control execution of one or more of the program modules depicted as being stored in the data storage 612. The O/S 616 may include any operating system now known or which may be developed in the future including, but not limited to, any server operating system, any mainframe operating system, or any other proprietary or non-proprietary operating system.

The DBMS 618 may be loaded into the memory 606 and may support functionality for accessing, retrieving, storing, and/or manipulating data stored in the memory 606 and/or data stored in the data storage 612. The DBMS 618 may use any of a variety of database models (e.g., relational model, object model, etc.) and may support any of a variety of query languages. The DBMS 618 may access data represented in one or more data schemas and stored in any suitable data repository. In certain example embodiments, the DBMS 618 may be any suitable light-weight DBMS optimized for performance on a mobile device.

The datastore(s) 634 may include, but are not limited to, databases (e.g., relational, object-oriented, etc.), file systems, flat files, distributed datastores in which data is stored on more than one node of a computer network, peer-to-peer network datastores, or the like. The datastore(s) 634 may store various types of data for the traffic controller 630 (and any number of additional traffic controllers) such as, for example, traffic controller input/output data 636, feature data 638 (which may include updated feature data), intersection signatures 640 (which may include calibrated intersection signatures), intersection health indicators 642, traffic sensor data 644, and feature calibration coefficient data 646 (e.g., coefficients for weighting feature values based on various operating conditions).

Referring now to other illustrative components of the traffic control system 602, the input/output (I/O) interface(s) 608 may facilitate the receipt of input information by the traffic control system 602 from one or more I/O devices as well as the output of information from the traffic control system 602 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the traffic control system 602 or may be separate. The I/O devices may further include, for example, any number of peripheral devices such as data storage devices, printing devices, and so forth.

The I/O interface(s) 608 may also include an interface for an external peripheral device connection such as universal serial bus (USB), FireWire, Thunderbolt, Ethernet port or other connection protocol that may connect to one or more networks. The I/O interface(s) 608 may also include a connection to one or more antennas to connect to one or more networks via a wireless local area network (WLAN) (such as Wi-Fi) radio, Bluetooth, and/or a wireless network radio, such as a radio capable of communication with a wireless communication network such as a Long Term Evolution (LTE) network, WiMAX network, 3G network, etc.

The traffic control system 602 may further include one or more network interfaces 610 via which the traffic control system 602 may communicate with any of a variety of other systems, platforms, networks, devices, and so forth. The network interface(s) 610 may enable communication, for example, with the traffic sensor(s) 628 and the traffic controller 630 via the network(s) 632.

It should be appreciated that the engines depicted in FIG. 6 as being stored in the data storage 612 and the program modules depicted in FIG. 3 are merely illustrative and not exhaustive and that processing described as being supported by any particular engine or module may alternatively be distributed across multiple engines, modules, or the like, or performed by a different engine, module, or the like. In addition, various program module(s), script(s), plug-in(s), Application Programming Interface(s) (API(s)), or any other suitable computer-executable code hosted locally on the traffic control system 602 and/or hosted on other computing device(s) accessible via one or more of the network(s) 632, may be provided to support functionality provided by the engines depicted in FIG. 6, functionality provided by the modules depicted in FIG. 3, and/or additional or alternate functionality. Further, functionality may be modularized differently such that processing described as being supported collectively by the collection of engines depicted in FIG. 6 or the collection of program modules depicted in FIG. 3 may be performed by a fewer or greater number of engines or program modules, or functionality described as being supported by any particular engine or module may be supported, at least in part, by another engine or program module. In addition, engines or program modules that support the functionality described herein may form part of one or more applications executable across any number of devices of the traffic control system 602 in accordance with any suitable computing model such as, for example, a client-server model, a peer-to-peer model, and so forth. In addition, any of the functionality described as being supported by any of the engines depicted in FIG. 6 or program modules depicted in FIG. 3 may be implemented, at least partially, in hardware and/or firmware across any number of devices.

It should further be appreciated that the traffic control system 602 may include alternate and/or additional hardware, software, or firmware components beyond those described or depicted without departing from the scope of the disclosure. More particularly, it should be appreciated that software, firmware, or hardware components depicted as forming part of the traffic control system 602 are merely illustrative and that some components may not be present or additional components may be provided in various embodiments. While various illustrative engines have been depicted and described as software engines or program modules stored in data storage 612, it should be appreciated that functionality described as being supported by the engines or modules may be enabled by any combination of hardware, software, and/or firmware. It should further be appreciated that each of the above-mentioned engines or modules may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular engine or module may, in various embodiments, be provided at least in part by one or more other engines or modules. Further, one or more depicted engines or modules may not be present in certain embodiments, while in other embodiments, additional engines or modules not depicted may be present and may support at least a portion of the described functionality and/or additional functionality. Moreover, while certain engines modules may be depicted or described as sub-engines or submodules of another engine or module, in certain embodiments, such engines or modules may be provided as independent engines or modules or as sub-engines or sub-modules of other engines or modules.

One or more operations of the methods 400 and 500 may be performed by a traffic control system 602 having the illustrative configuration depicted in FIG. 6, or more specifically, by one or more engines, program modules, applications, or the like executable on such device(s). It should be appreciated, however, that such operations may be implemented in connection with numerous other system configurations.

The operations described and depicted in the illustrative methods of FIGS. 4 and 5 may be carried out or performed in any suitable order as desired in various example embodiments of the disclosure. Additionally, in certain example embodiments, at least a portion of the operations may be carried out in parallel. Furthermore, in certain example embodiments, less, more, or different operations than those depicted in FIGS. 4 and 5 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular system, system component, device, or device component may be performed by any other system, device, or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program modules, applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program modules, or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

What is claimed is:

1. A method, comprising:

receiving, by a computer processor, first traffic controller data from a traffic controller configured to control traffic flow at an intersection, wherein the first traffic controller data is indicative of at least one of a first input to the traffic controller or a first output from the traffic controller;

determining, by the computer processor, first feature data based at least in part on the first traffic controller data, wherein the first feature data corresponds to one or more model features;

determining, by the computer processor and based at least in part on the first feature data, a model for the traffic flow at the intersection;

receiving, by the computer processor, second traffic controller data from the traffic controller, wherein the second traffic controller data is indicative of at least one of a second input to the traffic controller or a second output from the traffic controller;

determining, by the computer processor and based at least in part on the model and the second traffic controller data, presence of an abnormality in the traffic flow at the intersection, wherein the abnormality in the traffic flow at the intersection is indicative of an operational abnormality of the traffic controller, and wherein determining the presence of the abnormality comprises:

determining, by the computer processor, second feature data based at least in part on the second traffic controller data, wherein the second feature data corresponds to the one or more model features;

determining, by the computer processor, a metric indicative of a deviation between the second feature data and the model;

determining, by the computer processor, that the metric meets or exceeds a threshold value; and determining, by the computer processor, that the abnormality is present based at least in part on determining that the metric meets or exceeds the threshold value; and initiating, by the computer processor, an action to resolve the abnormality.

2. The method of claim 1, wherein initiating the action to resolve the abnormality comprises causing an alarm signal to be transmitted to the traffic controller to cause the traffic controller to adjust at least one of the second input or the second output to resolve the abnormality.

3. The method of claim 1, wherein the one or more model features comprise at least one of a time domain statistical feature or a frequency domain statistical feature.

4. The method of claim 1, further comprising:

receiving, by the computer processor, sensor data captured by one or more traffic sensors; and determining, by the computer processor and based at least in part on the sensor data, an operating condition of the traffic flow at the intersection, wherein determining the feature data comprises determining, by the computer processor, a respective coefficient to be applied to at least one model feature of the one or more model features based at least in part on the operating condition of the traffic flow at the intersection.

5. The method of claim 1, wherein the model is a first model, the method further comprising:

receiving, by the computer processor, first sensor data captured by one or more traffic sensors;

determining, by the computer processor and based at least in part on the first sensor data, a first operating condition of the traffic flow at the intersection, wherein the first traffic controller data and the first model correspond to the first operating condition;

receiving, by the computer processor, second sensor data captured by the one or more traffic sensors;

determining, by the computer processor and based at least in part on the second sensor data, a second operating condition of the traffic flow at the intersection, the second operating condition being different from the first operating condition;

receiving, by the computer processor, third traffic controller data from the traffic controller, wherein the third traffic controller data corresponds to the second sensor data;

determining, by the computer processor, third feature data based at least in part on the third traffic controller data, wherein the third feature data corresponds to the one or more model features; and determining, by the computer processor and based at least in part on the third feature data, a second model for the traffic flow at the intersection, wherein the second model corresponds to the second operating condition.

6. A system, comprising:

at least one memory storing computer-executable instructions; and at least one processor configured to access the at least one memory and execute the computer-executable instructions to:

receive first traffic controller data from a traffic controller configured to control traffic flow at an intersection, wherein the first traffic controller data is indicative of at least one of a first input to the traffic controller or a first output from the traffic controller;

determine first feature data based at least in part on the first traffic controller data, wherein the first feature data corresponds to one or more model features;

determine, based at least in part on the first feature data, a model for the traffic flow at the intersection;

receive second traffic controller data from the traffic controller, wherein the second traffic controller data is indicative of at least one of a second input to the traffic controller or a second output from the traffic controller;

determine, based at least in part on the model and the second traffic controller data, presence of an abnormality in the traffic flow at the intersection, wherein the abnormality in the traffic flow at the intersection is indicative of an operational abnormality of the traffic controller, and wherein the at least one processor is configured to determine the presence of the abnormality by executing the computer-executable instructions to:

determine second feature data based at least in part on the second traffic controller data, wherein the second feature data corresponds to the one or more model features;

determine a metric indicative of a deviation between the second feature data and the model;

determine that the metric meets or exceeds a threshold value; and determine that the abnormality is present based at least in part on determining that the metric meets or exceeds the threshold value; and initiate an action to resolve the abnormality.

7. The system of claim 6, wherein the at least one processor is configured to initiate the action to resolve the abnormality by executing the computer-executable instructions to cause an alarm signal to be transmitted to the traffic controller to cause the traffic controller to adjust at least one of the second input or the second output to resolve the abnormality.

8. The system of claim 6, wherein the one or more model features comprise at least one of a time domain statistical feature or a frequency domain statistical feature.

9. The system of claim 6, wherein the at least one processor is further configured to execute the computer-executable instructions to:

receive sensor data captured by one or more traffic sensors; and determine, based at least in part on the sensor data, an operating condition of the traffic flow at the intersection, and wherein the at least one processor is configured to determine the feature data by executing the computer-executable instructions to determine a respective coefficient to be applied to at least one model feature of the one or more model features based at least in part on the operating condition of the traffic flow at the intersection.

10. The system of claim 6, wherein the model is a first model, and wherein the at least one processor is further configured to execute the computer-executable instructions to:

receive first sensor data captured by one or more traffic sensors;

determine, based at least in part on the first sensor data, a first operating condition of the traffic flow at the intersection, wherein the first traffic controller data and the first model correspond to the first operating condition;

receive second sensor data captured by the one or more traffic sensors;

determine, based at least in part on the second sensor data, a second operating condition of the traffic flow at the intersection, the second operating condition being different from the first operating condition;

receive third traffic controller data from the traffic controller, wherein the third traffic controller data corresponds to the second sensor data;

determine third feature data based at least in part on the third traffic controller data, wherein the third feature data corresponds to the one or more model features; and determine, based at least in part on the third feature data, a second model for the traffic flow at the intersection, wherein the second model corresponds to the second operating condition.

11. A computer program product comprising a non-transitory storage medium readable by a processing circuit, the storage medium storing instructions executable by the processing circuit to cause a method to be performed, the method comprising: receiving, by a computer processor, first traffic controller data from a traffic controller configured to control traffic flow at an intersection, wherein the first traffic controller data is indicative of at least one of a first input to the traffic controller or a first output from the traffic controller;

determining first feature data based at least in part on the first traffic controller data, wherein the first feature data corresponds to one or more model features;

determining, based at least in part on the first feature data, a model for the traffic flow at the intersection;

receiving second traffic controller data from the traffic controller, wherein the second traffic controller data is indicative of at least one of a second input to the traffic controller or a second output from the traffic controller;

determining, based at least in part on the model and the second traffic controller data, presence of an abnormality in the traffic flow at the intersection, wherein the abnormality in the traffic flow at the intersection is indicative of an operational abnormality of the traffic controller, and wherein determining the presence of the abnormality comprises:

determining second feature data based at least in part on the second traffic controller data, wherein the second feature data corresponds to the one or more model features;

determining a metric indicative of a deviation between the second feature data and the model:

determining that the metric meets or exceeds a threshold value; and determining that the abnormality is present based at least in part on determining that the metric meets or exceeds the threshold value; and initiating an action to resolve the abnormality.

12. The computer program product of claim 11, wherein initiating the action to resolve the abnormality comprises causing an alarm signal to be transmitted to the traffic controller to cause the traffic controller to adjust at least one of the second input or the second output to resolve the abnormality.

13. The computer program product of claim 11, the method further comprising:

receiving, by the computer processor, sensor data captured by one or more traffic sensors; and determining, by the computer processor and based at least in part on the sensor data, an operating condition of the traffic flow at the intersection, wherein determining the feature data comprises determining, by the computer processor, a respective coefficient to be applied to at least one model feature of the one or more model features based at least in part on the operating condition of the traffic flow at the intersection.

14. The computer program product of claim 11, wherein the model is a first model, the method further comprising:

receiving, by the computer processor, first sensor data captured by one or more traffic sensors;

determining, by the computer processor and based at least in part on the first sensor data, a first operating condition of the traffic flow at the intersection, wherein the first traffic controller data and the first model correspond to the first operating condition;

receiving, by the computer processor, second sensor data captured by the one or more traffic sensors;

determining, by the computer processor and based at least in part on the second sensor data, a second operating condition of the traffic flow at the intersection, the second operating condition being different from the first operating condition;

receiving, by the computer processor, third traffic controller data from the traffic controller, wherein the third traffic controller data corresponds to the second sensor data;

determining, by the computer processor, third feature data based at least in part on the third traffic controller data, wherein the third feature data corresponds to the one or more model features; and determining, by the computer processor and based at least in part on the third feature data, a second model for the traffic flow at the intersection, wherein the second model corresponds to the second operating condition.

* * * * *